United States Patent [19]

Okumoto et al.

[11] Patent Number: 4,607,645

[45] Date of Patent: Aug. 26, 1986

[54] SHREDDED TOBACCO SUPPLYING DEVICE FOR CIGARETTE MAKING MACHINE

[75] Inventors: Yutaka Okumoto; Hideki Kobayashi; Kanjo Shiote; Toyomi Arakawa, all of Tokyo, Japan

[73] Assignee: Japan Tobacco Inc., Tokyo, Japan

[21] Appl. No.: 558,667

[22] Filed: Dec. 6, 1983

[30] Foreign Application Priority

Dec. 7, 1982 [JP] Japan ..... 57-213304

[51] Int. Cl.[4] ..... A24C 5/14; A24C 5/18

[52] U.S. Cl. ..... 131/109.1; 131/109.2; 131/110; 131/96

[58] Field of Search ..... 131/108, 109 R, 109 AB, 131/109 B, 110, 109.1, 109.2, 96

[56] References Cited

U.S. PATENT DOCUMENTS 3,996,943 12/1976 Hinzman ..... 131/109 B
4,175,570 11/1979 Heitmann ..... 131/108
4,463,768 8/1984 Quarella ..... 131/108

FOREIGN PATENT DOCUMENTS 0676087 5/1939 Fed. Rep. of Germany ... 131/109 B
1047982 11/1966 United Kingdom ..... 131/84 B

*Primary Examiner*—V. Millin
*Attorney, Agent, or Firm*—Armstrong, Nikaido, Marmelstein & Kobovcik

[57] ABSTRACT

A shredded tobacco supplying device for a cigarette making machine is disclosed, including a tank to receive shredded tobacco, a conveyor for unloading the shredded tobacco out of the tank, a high speed impeller positioned to scatter the unloaded shredded tobacco toward a vertical chimney arranged above the path of the scattered tobacco and connected to a negative pressure source to draw the lighter weight pieces through the chimney, a channel vertically arranged below the scattered tobacco to allow the heavier pieces to drop, and a mechanism for receiving and crushing the heavier pieces into smaller pieces and for supplying the crushed smaller pieces back to the impeller.

4 Claims, 3 Drawing Figures

SHREDDED TOBACCO SUPPLYING DEVICE FOR CIGARETTE MAKING MACHINE

BACKGROUND OF THE INVENTION

The present invention relates to a shredded tobacco supplying device in the cigarette making machine and more specifically to a shredded tobacco supplying device which has a function of processing stems which were separated from the shredded tobacco at the tobacco feeding section.

Among the important tasks for the cigarette makers, the maintaining of the cigarette quality and the reduction in the amount of the shredded tobacco used are gaining further importance as the price of leaf tobacco has shown a remarkable increase in recent years. The cigarette manufacturers are making their efforts to reduce the amount of tobacco as much as possible by reducing the variation in the weight of cigarettes, or by minimizing the collapsing of cigarette to improve bulkiness, or by injecting gases into the shredded cigarette to inflate the volume of cigarette. Although the reduction achieved for each cigarette may be very small, the overall reduction in the amount of tobacco for hundreds of millions of cigarettes will be enormous.

The abovementioned methods have already reached their limits of effectiveness and the manufacturers are looking for new means of reducing the amount of tobacco used.

One of the possible means is to reduce the amount of stems discharged from the shredded tobacco supplying apparatus. With the commonly used shredded tobacco supplying apparatuses, this means to reduce the amount of stems failed to be cut off and contained in the shredded tobacco—which are separated from the shredded tobacoo by the separating device. In other words, the maximum allowable limit of stem size to be rolled together with the shredded tobacco is increased. The ordinary shredded tobacco contains about 0.5% stems. If the allowable stem size is increased so that only 0.4% stems are removed and the remaining 0.1% stems are rolled together with the shredded tobacco, 0.1% reduction of shredded tobacco used will be realized. This will contribute greatly to the cost reduction.

However, as the allowable stem size is increased to include the greater stems to be rolled together with the shredded tobacco, the possibility increases that the pin holes will be formed in the roll paper and faulty cigarettes may reach the consumers. This in turn will greatly impair the manufacturer's credit.

For this reason, the cigarette manufacturer's conventionally recover the discharged stems and reused them as the material of the sheet tobacco. That is, the stems are crushed and mixed with paste. The clay mixture is rolled and dried and then is cut into leaf tobacco and further into small pieces. With this method, a large percentage of separated stems can be recovered but the above-mentioned complex processes are required, entailing enormous indirect expenses.

SUMMARY OF THE INVENTION

The cigarette producers are therefore seeking a new means to process the separated stems. This invention meets such needs by processing the stems within the shredded tobacco supplying apparatus.

Essentially there is provided a shredded tobacco supplying device for a cigarette making machine comprising a tank to receive shredded tobacco including light pieces and heavy pieces therewithin; means for unloading said shredded tobacco out of the tank; a high speed impellor to scatter said unloaded shredded tobacco substantially in a predetermined direction; a chimney structure vertically arranged substantially above said scattered shredded tobacco and connected to a negative pressure source at an upper portion thereof to draw the light pieces included in the scattered shredded tobacco through the chimney structure for a subsequent rolling operation; a channel vertically arranged substantially below said scattered shredded tobacco to allow the heavy pieces included in said scattered shredded tobacco to drop downward; and means for crushing said heavy pieces into smaller pieces which drop downward, supplying said smaller pieces back to the impellor.

DETAILED DESCRIPTION OF THE EMBODIMENT

A preferred embodiment of this invention will now be explained referring to the attached drawings. The operation characteristic and advantages of this invention will become apparent from the following description.

Figure 1:
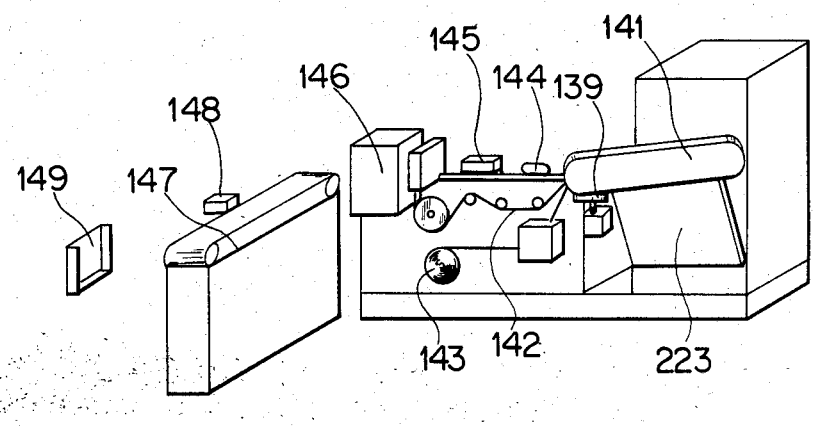
FIG. 1 is a schematic drawing of the cigarette making machine as viewed from the front, showing only the outline.

FIG. 1 shows a cigarette manufacturing machine. Shredded tobacco is carried up the chimney 223 and accumulated in layers by suction on the underside of the porous cigarette conveyor 141' which is located under the air suction chamber 141. The accumulated shredded tobacco is carried toward the left of the drawing to the trimming device 139 where the shredded tobacco layer is trimmed to a predetermined thickness. The tobacco of a certain thickness is then carried onto the sheets of rolling paper 143 stacked on the cloth tape 142. It is rolled in said rolling paper, pasted over by the pasting device 144, and heated by the heater 145 to form a single bar-like cigarette. The cigarette thus formed is passed through the density detector 150 by which the density of the tobacco contained is checked. The cigarette then is cut to standard size of cigarettes by the cutter 146. The cut cigarettes are carried on the conveyor 147. A solenoid valve 148 is located by the side of the conveyor to remove faulty cigarettes from the conveyor so as to load only those cigarettes of good quality into the tray 149.

Figure 2:
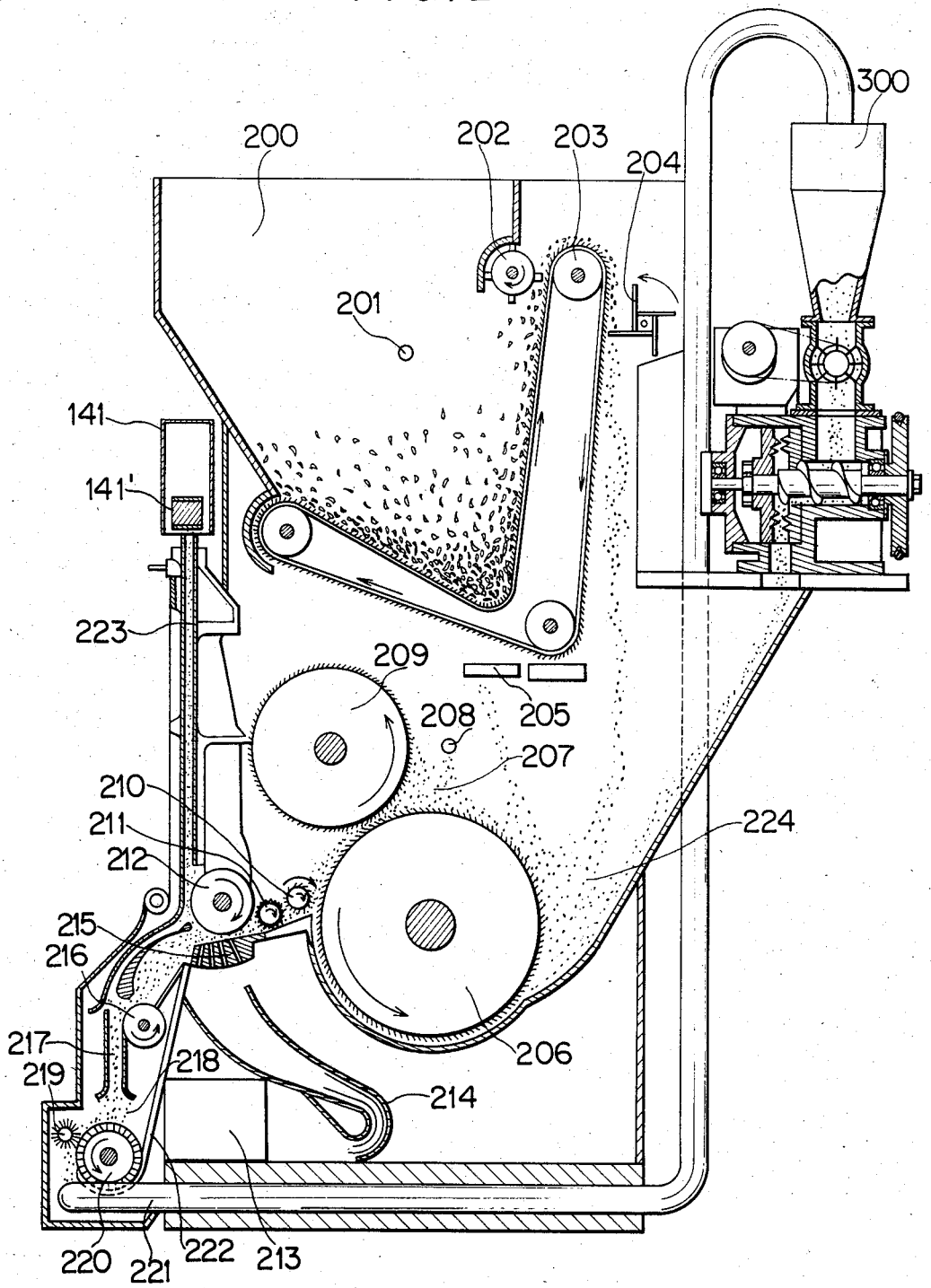
FIG. 2 is a cross-sectional view of the tobacco supplying device for the cigarette making machine.

FIG. 2 is a cross-sectional view of the shredded tobacco supplying device for the cigarette making machine. The shredded tobacco in most cases is supplied into the tank 200 by air flow. The amount of tobacco received in the tank 200 is determined by the height of the photoelectric tube 201. If the level of the shredded tobacco goes lower than the position of the photoelectric tube 201, additional shredded tobacco is supplied into the tank 200 from above. The tobacco in the tank 200 is carried up by the belt 203 attached with needles and excess tobacco is scraped off from the belt by the scraping roller 202 so that only the tobacco trapped among the needles can pass. In this way the amount of shredded tobacco that passes through the roller 202 has a certain relationship with the speed of the wired belt 203. The tobacco that passed the roller 202 is then scraped off by the vane 204 and falls to form a lump of shredded tobacco 224. In this way, the shredded tobacco received in the tank 200 is unloaded therefrom. Shredded tobacco that has been removed from the trimming device 139 is also carried by the vibrating conveyor 205 and dumped onto the lump of shredded tobacco 224.

The shredded tobacco forming the lump 224 is carried up by the needle on the first drum 206. By the action of the first drum 206 and the second drum 209, the latter rotating in such a direction as to hinder the passage of shredded tobacco between the two drums, a bar-like lump of shredded tobacco 207 is formed in front of the first and second drums 206 and 209 while including light pieces and heavy pieces therein. The amount of tobacco that passes through the gap between the two drums is controlled at a constant by slowing down the speed of the wired belt 203 when the photoelectric tube 208 detects the formation of the tobacco bar 207 and, when otherwise, by increasing the speed of the wired belt 203. In this way the size of the bar 207 is controlled at a constant.

The shredded tobacco that passed through the gap between the first and second drums 206 and 209 is broken, by the picker 210, into pieces of the adequate size for being rolled though still including light and heavy pieces therein and fed to a high speed impellor 211. The tobacco is then accelerated and scattered by the high speed impellor 211 substantially in a predetermined direction.

The shredded tobacco thus discharged is sorted out by the air which is supplied by pressure from the duct 213, made uniform by the regulating plate 214 and blown through the holes 215 to blow up the shredded tobacco which has been scattered by the high speed impellor 211. Light pieces of the tobacco attached to the suction roller 212 move up the chimney 223 vertically arranged substantially above the scattered shredded tobacco. Said chimney is connected at its upper portion to the air suction chamber 141 having a negative pressure source. Therefore, said light pieces are drawn upward through the chimney 223 and accumulated on the porous cigarette conveyor 141. Substantially below said scattered shredded tobacco is vertically arranged a channel 217 to allow the heavy pieces to drop downward. On the other hand, the heavy pieces move on across the blowing air and are thrown into the channel 217 by the drum 216. There is an air window 218 of an iron net at the buttom of the channel 217 from which air is flowing up under the influence of the air suction chamber 141. Because of the upward flow of air, only heavy pieces, i.e., stems contained in the shredded tobacco fall on roller 220.

The roller 220 has a plurality of floored pockets therearound to sort the stems separated from the shredded tobacco. The stems that fall into the pockets are returned as usable to the stream of the shredded tobacco by the channel 222 having a first opening at a lower portion to receive the stems from the pockets and a second opening at an upper portion. The stems that are too large to fall into the pockets are brushed off by the brush roller 219 and discharged through said air blowing pipe 221 having an opening below said brush roller 219.

Conventionally, these stems discharged by the air blowing pipe 221 are collected by the dust collector outside the cigarette making machine and then disposed of. Or they are reused by the method mentioned before.

In this embodiment the air blowing pipe 221 is connected to a known cyclone 300 having a suitable suction means. Said cyclone 300 sorts out air flow and the stems therein.

Figure 3:
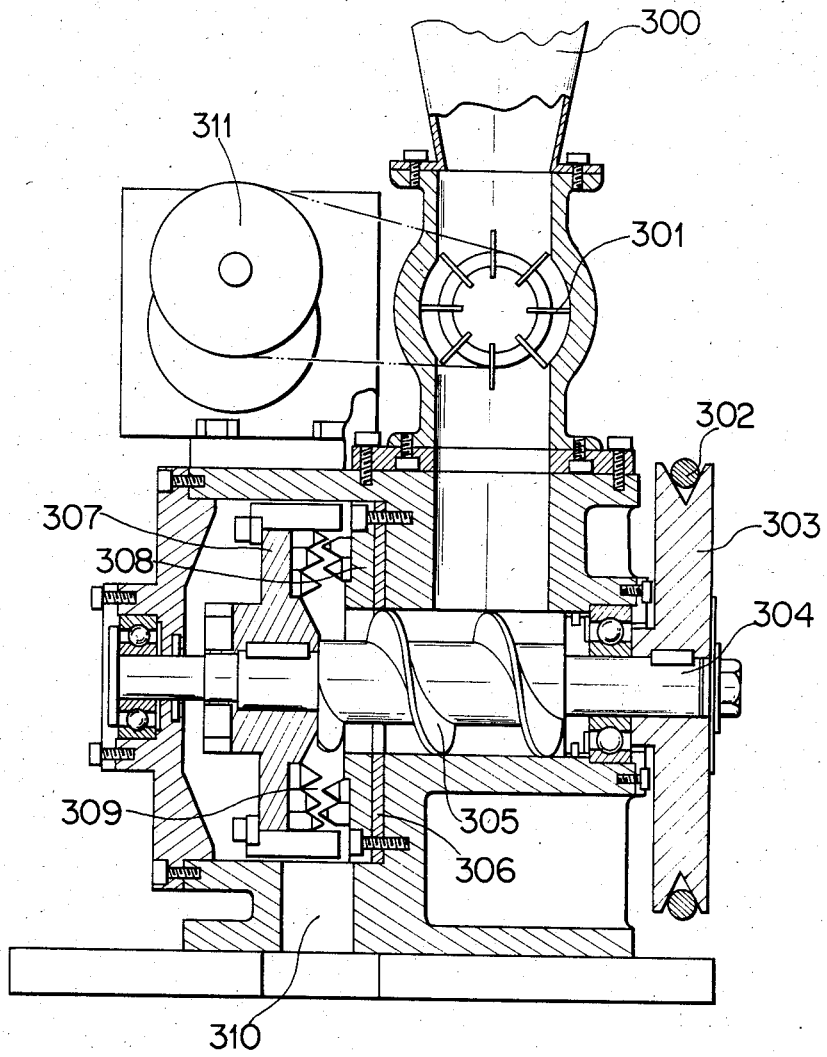
FIG. 3 is a cross-sectional view of the stem crushing device.

FIG. 3 shows the cross section of the stem removing device of the embodiment.

The stems collected by the cyclone 300 are received by the vanes 301 rotated by the motor 311 and are sent downward. The stems then fall on the shaft 304 which is mounted, by means of key and screws, to the pulley 303 which is driven by the round belt 302. The shaft 304 is attached with a twisted vane 305 so that the stems move toward the left of the drawing and fall between the teeth 307 and 308. The gap between the teeth 307 and 308 can be adjusted by a shim 306.

In this embodiment, the teeth 308 are fixed while the teeth 307 are rotated together with the shaft 304. But it does not matter which teeth are made to rotate. As the gap between the teeth 307 and 308 is gradually reduced, there are greater chances of large stems touching the teeth to be crushed into smaller pieces while the possibility of smaller stems touching the teeth remains relatively small. Therefore the stems falling through the opening 310 will be almost equal in size, each slightly expanding such that its density is lowered.

The stems that fall through the opening 310 form a lump of shredded tobacco 224 which will be returned to the stream of the shredded tobacco as shown in FIG. 2. As already explained, when the stems are discharged into the high speed impellor 211, they have been ground into smaller size and are readily blown by wind toward the chimney 223. Thus the stems this time will not move across the wind toward the throw-out roller 216.

In this way, with this invention, not a single stem will be discharged out of the machine and all stems are reduced into appropriate size and mixed with shredded tobacco. This will realize great reduction in the amount of shredded tobacco used in the cigarette making.

What is claimed is:

1. A shredded tobacco supplying device for a cigarette making machine comprising:

feeding means for feeding shredded tobacco including heavy and light tobacco pieces in a regulated manner;

a high speed impellor arranged to receive shredded tobacco from said feeding means and scatter said tobacco in a predetermined direction;

a chimney structure vertically arranged substantially above the path of said scattered shredded tobacco and connected to a negative pressure source at an upper portion thereof, whereby light pieces of said tobacco are drawn through said chimney structure for a subsequent cigarette rolling operation;

a channel vertically arranged substantially below said scattered shredded tobacco to receive pieces included in said scattered shredded tobacco that dropped downward;

means for collecting said dropped pieces;

means for crushing said dropped pieces into smaller pieces of reduced weight;

means for supplying said crushed pieces back to said feeding means.

2. A shredded tobacco supplying device according to claim 1, further including means for breaking said fed shredded tobacco into pieces of adequate size for said rolling operation and for feeding said tobacco to said high speed impellor.

3. A shredded tobacco supplying device for a cigarette machine according to claim 5, further including means for sorting said dropped pieces of shredded tobacco into heavy pieces and light pieces, including means for sending said heavy pieces to said crushing means and allowing said light pieces to be drawn by said a negative pressure source up through said chimney structure.

4. A shredded tobacco supplying device for a cigarette making machine comprising:

tobacco feeding means for continuously feeding shredded tobacco, including impellor means arranged to scatter said shredded tobacco in a predetermined generally horizontal path;

means for creating a vertical flow of air through said path of said scatter shredded tobacco and operating to lift lighter pieces of said tobacco;

collecting means arranged below said path to receive heavy pieces of tobacco not lifted by said vertical flow of air;

tobacco crushing means adapted to crush tobacco into smaller pieces of reduced weight;

means for receiving collected tobacco from said collecting means and carrying said tobacco to said crushing means to be crushed thereby;

means for supplying said crushed tobacco pieces to said tobacco feeding means for reprocessing.

* * * * *